US010536787B2

(12) United States Patent
Rosenthal et al.

(10) Patent No.: US 10,536,787 B2
(45) Date of Patent: Jan. 14, 2020

(54) CONFIGURATION OF FEEDBACK CANCELATION FOR HEARING AIDS

(71) Applicant: Starkey Laboratories, Inc., Eden Prairie, MN (US)

(72) Inventors: Joyce Rosenthal, Golden Valley, MN (US); Ivo Merks, Eden Prairie, MN (US)

(73) Assignee: Starkey Laboratories, Inc., Eden Pairie, MN (US)

( * ) Notice: Subject to any disclaimer, the term of this patent is extended or adjusted under 35 U.S.C. 154(b) by 385 days.

(21) Appl. No.: 15/368,118

(22) Filed: Dec. 2, 2016

(65) Prior Publication Data

US 2018/0160237 A1 Jun. 7, 2018

(51) Int. Cl.
*H04R 25/00* (2006.01)

(52) U.S. Cl.
CPC ..... *H04R 25/453* (2013.01); *H04R 25/30* (2013.01); *H04R 25/505* (2013.01)

(58) Field of Classification Search
CPC .... H04R 25/453; H04R 25/30; H04R 25/505; H04R 25/70; H04R 2225/55; H04R 25/305
USPC ..... 381/318
See application file for complete search history.

(56) References Cited

U.S. PATENT DOCUMENTS 6,072,884 A 6/2000 Kates
7,054,437 B2 5/2006 Enzner
7,058,182 B2 6/2006 Kates
7,181,297 B1 2/2007 Pluvinage et al.
7,386,142 B2 6/2008 Kindred
7,496,205 B2 2/2009 Kühnel
7,809,150 B2 10/2010 Natarajan et al.
8,243,938 B2 8/2012 Boretzki et al.
8,737,655 B2 5/2014 Merks et al.
9,723,415 B2 * 8/2017 Gran ..... H04R 25/407
9,838,805 B2 * 12/2017 Gran ..... H04R 25/407
10,028,066 B2 * 7/2018 Schmidt ..... H04R 25/30
10,154,357 B2 * 12/2018 Gran ..... H04R 25/407
(Continued)

FOREIGN PATENT DOCUMENTS

EP 1964441 B1 1/2011
EP 2549397 A1 1/2013
(Continued)

OTHER PUBLICATIONS

Van Waterschoot et al., "Fifty Years of Acoustic Feedback Control: State of the Art and Future Challenges," Proceedings of the IEEE, vol. 99, No. 2, Feb. 2011, pp. 288-327.
(Continued)

*Primary Examiner* — Phylesha Dabney
(74) *Attorney, Agent, or Firm* — Shumaker & Sieffert, P.A.

(57) ABSTRACT

In one example, a method includes determining, by one or more processors of a hearing aid programmer, values for one or more properties of a first hearing aid; obtaining, by the one or more processors, based on feedback cancelation configurations of a plurality of other hearing aids having the same values for the one or more properties as the first hearing aid, a predicted initial feedback cancelation configuration for the first hearing aid; and programming, by the one or more processors, the first hearing aid based on the predicted initial feedback cancelation configuration.

18 Claims, 9 Drawing Sheets

(56) References Cited

U.S. PATENT DOCUMENTS

| | | | | |
|---|---|---|---|---|
| 2002/0176584 | A1 | 11/2002 | Kates | |
| 2005/0265568 | A1 | 12/2005 | Kindred | |
| 2012/0183164 | A1 | 7/2012 | Foo et al. | |
| 2015/0271607 | A1 | 9/2015 | Sabin | |
| 2016/0373869 | A1* | 12/2016 | Gran | H04R 25/407 |
| 2017/0055090 | A1* | 2/2017 | Gran | H04R 25/407 |
| 2017/0295440 | A1* | 10/2017 | Gran | H04R 25/407 |

FOREIGN PATENT DOCUMENTS

| | | | |
|---|---|---|---|
| WO | 2001054458 | A2 | 7/2001 |
| WO | 2014023340 | A1 | 2/2014 |

OTHER PUBLICATIONS

Hamacher et al., "Signal processing in high-end hearing aids: State of the art, challenges, and future trends," EURASIP Journal on Applied Signal Processing, Nov. 2005, pp. 2915-2929.

Egolf et al., "The hearing aid feedback path: Mathematical simulations and experimental verification," The Journal of the Acoustical Society of America, vol. 78.5, Jun. 1985, pp. 1578-1587.

Hellgren et al., "Variations in the feedback of hearing aids," The Journal of the Acoustical Society of America, vol. 106.5, Aug. 1999, pp. 2821-2833.

Ezner, "Bayesian inference model for applications of time-varying acoustic system identification," 18th European Signal Processing Conference, Aug. 23-27, 2010, pp. 2126-2130.

"Netflix Prize," Wikipedia, the free encyclopedia, retrieved from https://en.wikipedia.org/wiki/Netflix_Prize, Jan. 23, 2017, 6 pp.

Bernardi, "A PEM-based frequency-domain Kalman filter for adaptive feedback cancellation," 23rd European Signal Processing Conference, Sep. 2015, pp. 270-274.

Bernardi, "An All-Frequency-Domain Adaptive Filter with PEM-Based Decorrelation for Acoustic Feedback Control," IEEE Workshop on Applications of Signal Process. to Audio and Acoustics, Oct. 2015, 5 pp.

Haykin, "Adaptive filter theory," Pearson Education India, Dec. 2008, pp. 18-34.

"Matrix completion," Wikipedia, the free encyclopedia, retrieved from https://en.wikipedia.org/wiki/Matrix_completion, Dec. 12, 2016, 8 pp.

"A/B testing," Wikipedia, the free encyclopedia, retrieved from https://en.wikipedia.org/wiki/A/B_testing, Jan. 24, 2017, 5 pp.

Extended Search Report from counterpart European Application No. 17204475.2, dated Mar. 1, 2018, 7 pp.

* cited by examiner

CONFIGURATION OF FEEDBACK CANCELATION FOR HEARING AIDS

BACKGROUND

Hearing assistance devices, such as hearing aids, are used to assist a patient who is suffering hearing loss by transmitting amplified sounds to the patient's ear canals. For instance, a hearing aid may include one or more microphones to receive sound, signal processing components to process the received sounds, and one or more speakers to output the processed sounds. Hearing aids may be prone to acoustic feedback problems as the microphones may receive some of the sounds output by the speakers, creating a feedback loop that may result in howling, whistling, or oscillation.

SUMMARY

In one example, a method includes determining, by one or more processors of a hearing aid programmer, values for one or more properties of a first hearing aid; obtaining, by the one or more processors, based on feedback cancelation configurations of a plurality of other hearing aids having the same values for the one or more properties as the first hearing aid, a predicted initial feedback cancelation configuration for the first hearing aid; and programming, by the one or more processors, the first hearing aid based on the predicted initial feedback cancelation configuration.

In another example, a hearing aid programmer includes an output configured to program hearing aids; and one or more processors configured to: determine values for one or more properties of a first hearing aid; obtain, based on feedback cancelation configurations of a plurality of other hearing aids having the same values for the one or more properties as the first hearing aid, a predicted initial feedback cancelation configuration for the first hearing aid; and program, via the output, the first hearing aid based on the predicted initial feedback cancelation configuration.

In another example, a method includes obtaining, by one or more processors, feedback cancelation configurations of a plurality of hearing aids and values of one or more properties of the plurality of hearing aids; determining, by the one or more processors and based on feedback cancelation configurations of hearing aids of the plurality of hearing aids that have a particular set of values of the one or more properties, a predicted initial feedback cancelation configuration for a hearing aid having the particular set of values for the one or more properties; and outputting, for transmission to a hearing aid programmer, the determined predicted initial feedback cancelation configuration for the hearing aid having the particular set of values for the one or more properties.

In another example, a system includes a system comprising: a storage device configured to store feedback cancelation configurations of a plurality of hearing aids and values of one or more properties of the plurality of hearing aids; one or more processors operatively connected to the memory, the one or more processors configured to determine, based on feedback cancelation configurations of hearing aids of the plurality of hearing aids that have a particular set of values of the one or more properties, a predicted initial feedback cancelation configuration for a hearing aid having the particular set of values for the one or more properties; and an output configured to transmit, to a hearing aid programmer, the determined predicted initial feedback cancelation configuration for the hearing aid having the particular set of values for the one or more properties.

In another example, a method includes: receiving, by one or more processors of a hearing aid, a predicted initial feedback cancelation configuration for the first hearing aid having one or more properties, wherein the initial feedback cancelation configuration is based on feedback cancelation configurations of other hearing aids having the same properties as the hearing aid; and controlling, by the one or more processors, the hearing aid based on the predicted initial feedback cancelation configuration.

In another example, a hearing aid includes: one or more microphones; one or more speakers; a communication module configured to receive a predicted initial feedback cancelation configuration for the hearing aid, wherein the initial feedback cancelation configuration is based on feedback cancelation configurations of other hearing aids having the same properties as the hearing aid; and a signal processor configured to implement a feedback cancelation loop between the one or more microphones and the one or more speakers based on the predicted initial feedback cancelation configuration.

The details of one or more examples are set forth in the accompanying drawings and the description below. Other features, objects, and advantages will be apparent from the description and drawings, and from the claims.

DETAILED DESCRIPTION

In general, this disclosure is directed to devices, systems, and methods for predicting parameters to configure hearing aids. A clinician (e.g., an audiologist) may configure one or more aspects of a hearing aid as part of a fitting procedure. For instance, a clinician may program one or more parameters of a feedback canceler of the hearing aid, initialize and/or train the feedback canceler, and/or determine one or more gain limits of the hearing aid. However, in some examples, the configuration performed by the clinician may be sub-optimal and/or the clinician may omit one or more components of the fitting procedure.

In accordance with one or more techniques of this disclosure, a device may automatically predict one or more parameters for a hearing aid based on parameters of other hearing aids with similar properties. For instance, a device may predict parameters for a feedback canceler of a particular hearing aid based on parameters for feedback cancelers of other hearing aids with similar properties as the particular hearing aid. In this way, the device may reduce fitting time and may improve patient outcomes.

Figure 1:
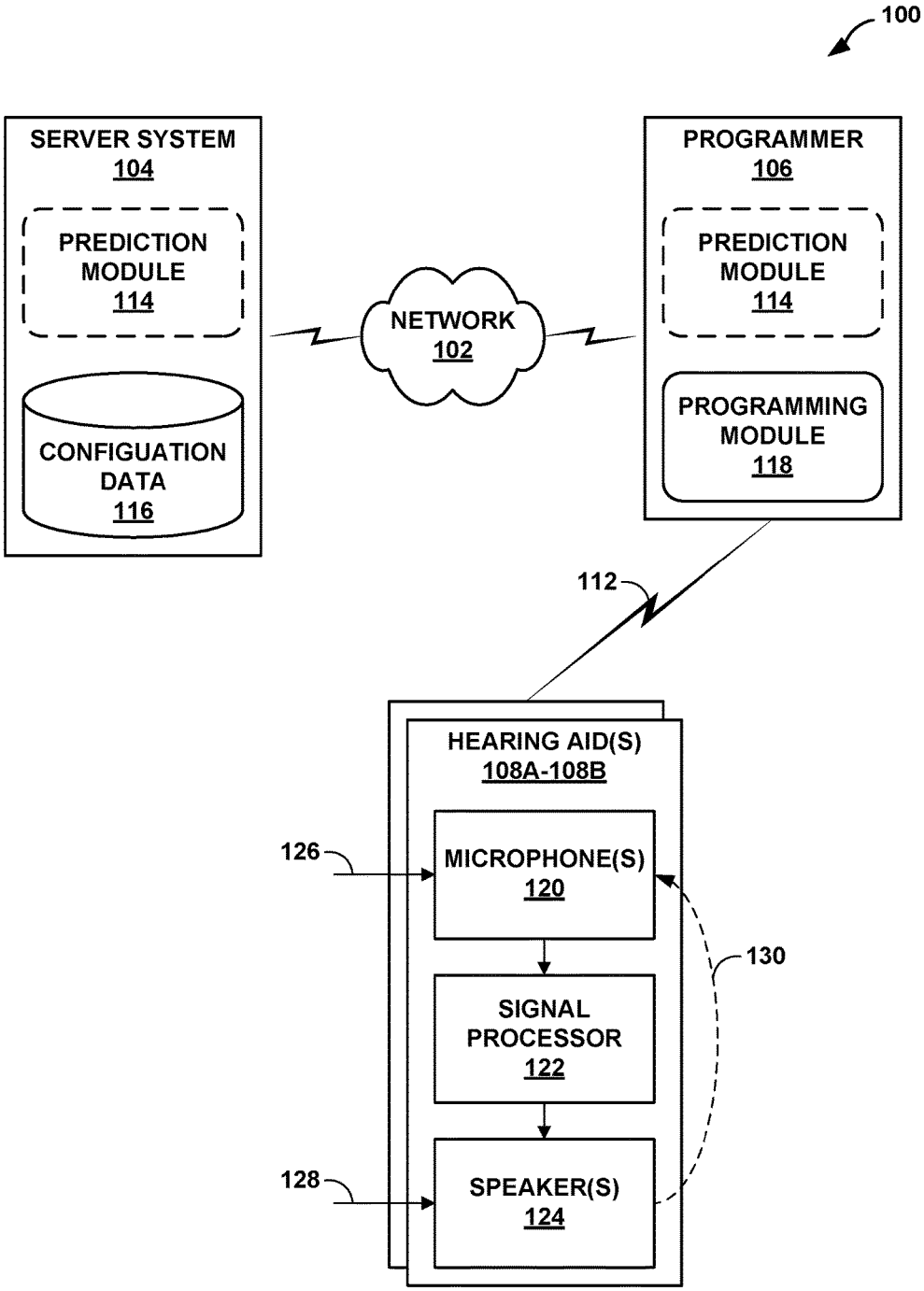
FIG. 1 is a block diagram illustrating an example hearing assistance system, in accordance with one or more aspects of the present disclosure.

FIG. 1 is a block diagram illustrating an example hearing assistance system, in accordance with one or more aspects of the present disclosure. System 100 of FIG. 1 includes server system 104, programmer 106, and hearing aids 108A and 108B (collectively, "hearing aids 108"). As shown in FIG. 1, server system 104 and programmer 106 may be in communication via network 102.

Network 102 represents any public or private communications network, for instance, cellular, Wi-Fi, and/or other types of networks, for transmitting data between computing systems, servers, and computing devices. Server system 104 may exchange data, via network 102, with programmer 106 to facilitate the programming, diagnostic, or any other such activity of hearing aids, such as hearing aids 108.

Network 102 may include one or more network hubs, network switches, network routers, or any other network equipment, that are operatively inter-coupled thereby providing for the exchange of information between server system 104 and programmer 106. Server system 104 and programmer 106 may transmit and receive data across network 102 using any suitable communication techniques. Server system 104 and programmer 106 may each be operatively coupled to network 102 using respective network links. The links coupling server system 104 and programmer 106 to network 102 may be Ethernet or other types of network connections and such connections may be wireless and/or wired connections.

Server system 104 may represent any suitable remote computing system, such as one or more desktop computers, laptop computers, mainframes, servers, cloud computing systems, etc. capable of sending and receiving information both to and from a network, such as network 102. Server system 104 may host (or at least provides access to) a hearing aid configuration service. In some examples, server system 104 may represent a cloud computing system that provides access to the hearing aid configuration service.

Programmer 106 represents equipment capable of initializing, programming, and/or otherwise configuring hearing aids, such as hearing aids 108. Programmer 106 may be configured to communicate, either wired or wirelessly, with hearing aids 108 as needed to provide or retrieve configuration information via link 112. Programmer 106 is an external computing device that the user, e.g., the clinician and/or a patient, may use to communicate with hearing aids 108. For example, programmer 106 may be a clinician programmer that the clinician uses to communicate with hearing aids 108 and program one or more configuration settings for hearing aids 108. In addition, or instead, programmer 106 may be a patient programmer that allows a patient to select programs and/or view and modify configuration values. The clinician programmer may include more programming features than the patient programmer. In other words, more complex or sensitive tasks may only be allowed by the clinician programmer to prevent an untrained patient from making undesired changes to hearing aids 108.

Programmer 106 may be a hand-held computing device with a display viewable by the user and an interface for providing input to programmer 106 (i.e., a user input mechanism). For example, programmer 106 may include a display screen (e.g., a liquid crystal display (LCD) or a light emitting diode (LED) display) that presents information to the user. In addition, programmer 106 may include a touch screen display, keypad, buttons, a peripheral pointing device, voice activation, or another input mechanism that allows the user to navigate through the user interface of programmer 106 and provide input. If programmer 106 includes buttons and a keypad, the buttons may be dedicated to performing a certain function, e.g., a power button, the buttons and the keypad may be soft keys that change in function depending upon the section of the user interface currently viewed by the user, or any combination thereof.

In other examples, programmer 106 may be a larger workstation or a separate application within another multi-function device, rather than a dedicated computing device. For example, the multi-function device may be a notebook computer, tablet computer, workstation, one or more servers, cellular phone, personal digital assistant, or another computing device that may run an application that enables the computing device to operate as a secure medical device programmer 106. A wireless adapter coupled to the computing device may enable secure communication between the computing device and hearing aids 108.

Programmer 106 may be used to transmit programming information to hearing aids 108. Programming information may include, for example, audio processing parameters, such as one or more parameters of a feedback canceler or feedback cancelation loop implemented by hearing aids 108, and any other information that may be useful for programming into hearing aids 108. Programmer 106 may also be capable of triggering events, such as causing hearing aids 108 to perform one or more initialization, measurement, calibration, or characterization activities.

Hearing aids 108 may be used to assist a patient who is suffering hearing loss by transmitting amplified sounds to the patient's ear canals. Examples of hearing aids 108 include, but are not necessarily limited to, behind-the-ear (BTE) type hearing aids, in-the-ear (ITE) type hearing aids, in-the-canal (ITC) type hearing aids, completely-in-the-canal (CIC) type hearing aids, invisible-in-the-canal (IIC) type hearing aids, or deep-insertion stock CIC (DISC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the patient.

As illustrated in FIG. 1, each of hearing aids 108 may include one or more microphones 120 configured to generate a signal to represent input sound 126, signal processor 122 configured to process the signal to generate a processed signal, and one or more speakers 124 configured to emit output sound 128 based on the processed signal. Further details of one example of a hearing aid of hearing aids 108 are discussed below with reference to FIG. 2.

Signal processor 122 may process the signal in a number of ways. For instance, signal processor 122 may amplify the signal based on one or more programmable gain levels, which may be adjusted based on the hearing impairment of a particular user of hearing aids 108. In some examples, signal processor 122 may amplify all frequencies of the signal by a common gain level. In some examples, a range of audio frequencies may be divided into a plurality of bands and signal processor 122 may amplify each of the plurality of bands by a respective gain level. The loudness of output sound 128 may be relative to the gain level(s) applied by signal processor 122. For instance, the loudness of output sound 128 may increase as the gain level(s) applied by signal processor 122 increases. As such, higher gain levels may be used for users of hearing aids 108 that have greater hearing impairments.

However, excessive gain levels may result in acoustic feedback. In particular, if signal processor 122 amplifies the signal with too much gain, the sound received by microphone(s) 120 may include a portion of the output sound emitted by speaker(s) 124, referred to as acoustic feedback 130, in addition to input sound 126. Without mitigation, the presence of acoustic feedback 130 may result in undesirable whistling or squealing sounds being included in output sound 128.

Several techniques may be employed to combat acoustic feedback 130, which may be utilized individually or in combination. As one example, the gain levels used by signal processor 122 may be restricted below a "maximum stable gain" (MSG), which may be the amount of gain that can be applied by signal processor 122 before acoustic feedback 130 occurs. In some examples, the MSG of signal processor 122 may be a function of frequency. For instance, there may be a respective MSG of signal processor 122 for each band of the plurality of bands.

As another example, signal processor 122 may implement a feedback canceler. For instance, signal processor 122 may implement a negative feedback loop (i.e., a feedback cancelation loop) with a configurable bulk delay to mitigate the effects of acoustic feedback 130. In some examples, the bulk delay may represent the amount of time taken for sound to travel around the complete loop. For instance, the bulk delay may represent the sum of the amount of taken for synthesis of a filterbank, the amount of time taken by a digital to analog converter, the amount of time taken by speakers 124 to generate the sound, the acoustic delay (i.e., the amount of time taken for a sound emitted from speaker(s) 124 to travel to microphone(s) 120), the amount of time taken by microphones 120 to generate an analog signal based on the sound, the amount of time taken by an analog to digital converter to convert the analog signal to a digital signal, and the amount of time taken by the filterbank for analysis. The accuracy of the bulk delay value used by signal processor 122 may be related to the performance of the feedback canceler. In particular, a more accurate bulk delay value may enable signal processor 122 to better mitigate the effects of acoustic feedback 130. As such, it may be desirable for signal processor 122 to utilize an accurate bulk delay value.

A clinician (e.g., an audiologist) may configure one or more aspects of hearing aid 108 as part of a fitting procedure. As one example, the clinician may utilize programmer 106 to estimate a MSG of one or both of hearing aids 108. As another example, the clinician may utilize programmer 106 to program one or more parameters of a feedback canceler of one or both of hearing aids 108. For instance, the clinician may utilize programmer 106 to cause one or both of hearing aids 108 to perform an initialization procedure to estimate an initial bulk delay value. In some examples, to perform the initialization procedure, a hearing aid of hearing aids 108 may measure the amount of time elapsed between when a sound is emitted from speaker(s) 124 and when the sound is received by microphone(s) 120.

In some examples, programmer 106 may output results of the fitting procedure to one or more other devices, such as server system 104. For instance, programmer 106 may output the programmed parameters of the feedback canceler of a hearing aid of hearing aids 108 and/or the MSG of the hearing aid of hearing aids 108 to server system 104 along with values for one or more properties of the hearing aid of hearing aids 108. The properties may include, but are not limited to, physical properties of the hearing aid (e.g., model information, vent size, properties of an earmold of the hearing aid) and properties of signal processor 122. Server system 104 may store the received results in configuration data 116.

In accordance with one or more techniques of this disclosure, a device (e.g., programmer 106 and/or server system 104) may automatically predict one or more parameters for a hearing aid of hearing aids 108 based on parameters of other hearing aids with similar properties. For instance, prediction module 114 of server system 104 and/or programmer 106 may predict one or more parameters, such as a bulk delay, for a feedback canceler of a hearing aid of hearing aids 108 based on parameters for feedback cancelers of other hearing aids with similar properties as the particular hearing aid stored in configuration data 116.

Programming module 118 may program the hearing aid of hearing aids 108 based on the predicted parameters. For instance, programming module 118 may communicate with the hearing aid via link 112 to store the predicted parameters in a memory of the hearing aid. In some examples, the parameters predicted by prediction module 114, and stored at the hearing aid, may be more accurate than parameters selected by the practitioner and/or more accurate than parameters determined via the initialization process. For instance, an initial bulk delay value predicted by prediction module 114 may be more accurate than a default initial bulk delay value or an initial bulk delay value determined via the initialization process. As such, by using parameters predicted based on parameters of other hearing aids, signal processor 122 may better mitigate the effects of acoustic feedback 130. Similarly, in some examples, by using parameters predicted based on parameters of other hearing aids, the clinician may omit performance of all or a portion of the initialization process. In this way, the techniques of this disclosure may reduce fitting time and may improve patient outcomes.

In some examples, because the predicted bulk delay value may be more accurate than a bulk delay value estimated by hearing aids 108 (e.g., an in-field bulk delay estimate), hearing aids 108 may omit estimation of bulk delay values. In this way, the techniques of this disclosure may reduce the computational load of hearing aids 108 (i.e., free-up clock cycles), reduce the amount of operating memory needed, and/or reduce the amount of memory needed to store firmware/software.

Figure 2:
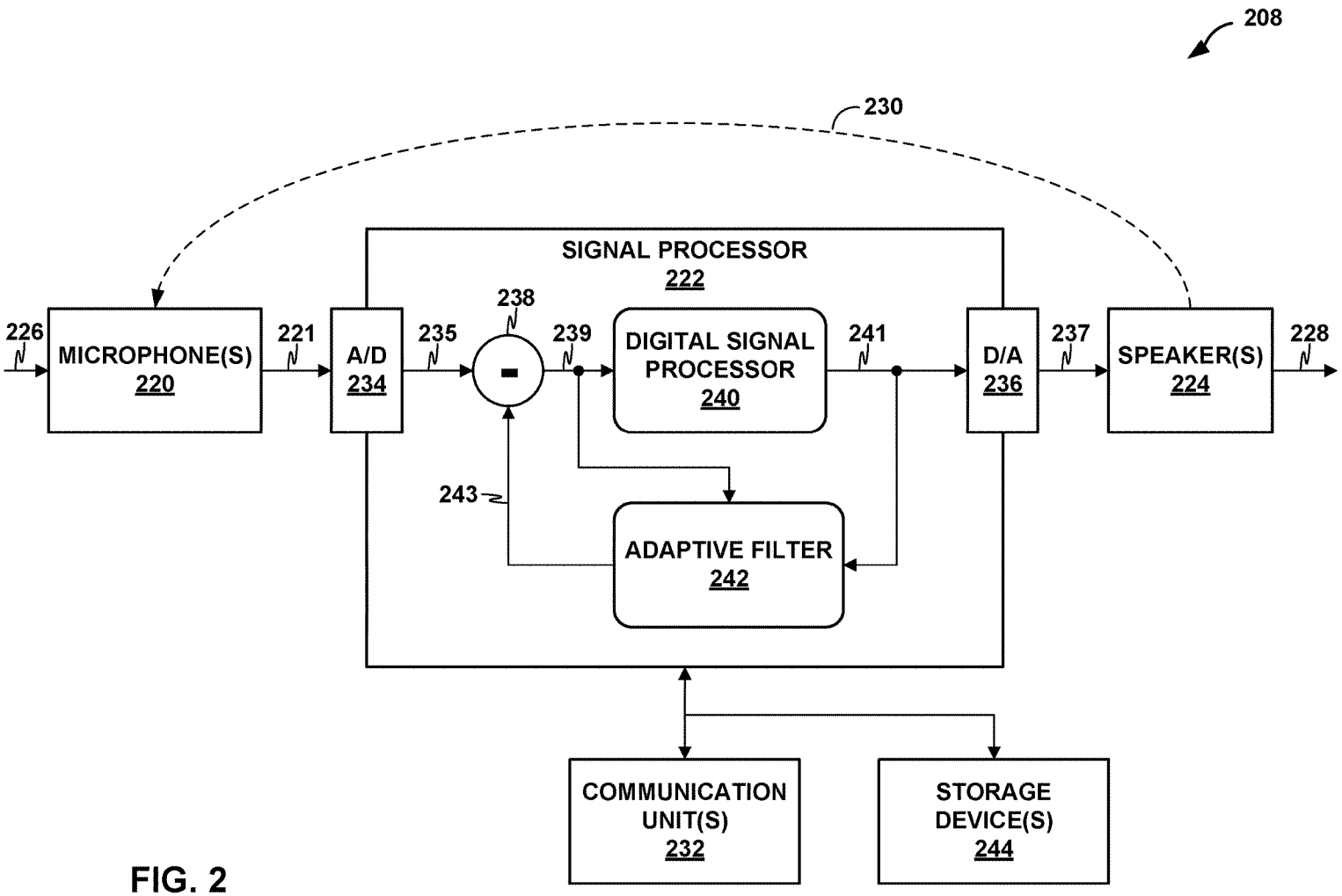
FIG. 2 is a block diagram illustrating an example hearing aid, in accordance with one or more aspects of the present disclosure.

FIG. 2 is a block diagram illustrating an example hearing aid, in accordance with one or more aspects of the present disclosure. Hearing aid 208 of FIG. 2 is described below as an example of a hearing aid of hearing aids 108 of FIG. 1. FIG. 2 illustrates only one particular example of hearing aid 208, and many other examples of hearing aid 208 may be used in other instances and may include a subset of the components included in example hearing aid 208 or may include additional components not shown in FIG. 2. For instance, hearing aid 208 may include a battery or other power source configured to provide power to one or more components of hearing aid 208.

As shown in the example of FIG. 2, hearing aid 208 includes one or more microphones 220, analog-to-digital (A/D) converter 234, signal processor 222, digital-to-analog (D/A) converter 236, one or more speakers 224, one or more communication units 232, and one or more storage devices 244.

Microphone(s) 220 may be configured to perform functions similar to microphone(s) 120 of FIG. 1. For instance, microphone(s) 220 may generate a signal that represents received sounds. In the example of FIG. 2, microphone(s) 220 may generate analog signal 221 that represents input sound 226 and acoustic feedback 230 (if present).

A/D 234 and D/A 236 may be configured to convert signals between analog and digital domains. For instance, A/D 234 may be configured to generate a digital signal to represent a received analog signal and D/A 236 may be configured to generate an analog signal to represent a received digital signal. In the example of FIG. 2, A/D 234 may generate digital signal 235 to represent analog signal 221 and D/A 236 may generate analog signal 237 to represent digital signal 241. In some examples, one or both of A/D 234 and D/A 236 may be standalone components. For instance, one or both of A/D 234 and D/A 236 may be discrete chips. In some examples, one or both of A/D 234 and D/A 236 may be integrated into one or more other components of hearing aid 208. As one example, A/D 234 may be integrated into microphone(s) 220 and/or D/A 236 may be integrated into speaker(s) 224. As another example, one or both of A/D 234 and D/A 236 may be integrated into signal processor 222.

Speaker(s) 224 may be configured to perform functions similar to speaker(s) 124 of FIG. 1. For instance, speaker(s) 224 may emit sounds to an ear canal of a user of hearing aid 108. In the example of FIG. 2, speaker(s) 224 may emit, based on signal 237, output sound 228 to an ear canal of a user of hearing aid 108. In some examples, speakers 224 may be referred to as receivers.

Signal processor 222 may be configured to perform functions similar to signal processor 122 of FIG. 1. For instance, signal processor 222 may amplify, filter, transform, or otherwise process representations of sounds to provide a user of hearing aid 108 with an improved hearing experience. As shown in the example of FIG. 2, signal processor 222 may include subtractor 238, digital signal processor (DSP) 240, and adaptive filter 242.

As discussed above, in some examples, acoustic output from speaker(s) 224 may couple with microphone(s) 220 through a variety of possible signal paths. Some example acoustic feedback paths may include air paths between speaker(s) 224 and microphone(s) 220, sound conduction paths via the enclosure of hearing aid 208, and sound conduction paths within the enclosure of hearing aid 208. Such coupling paths are collectively shown in FIG. 2 as acoustic feedback 230.

Subtractor 228, DSP 240, and adaptive filter 242 may be configured in a negative feedback configuration to provide a cancellation of the acoustic feedback 230. For instance, adaptive filter 230 may determine an estimate of what portion, if any, of output sound 228 was captured by microphones 220. Adaptive filter 230 may output acoustic feedback estimate 243, which represents the estimate of what portion of output sound 228 was captured by microphones 220, to subtractor 238. As discussed in further detail below, adaptive filter 230 may generate acoustic feedback estimate 243 based at least in part on one or more coefficients and/or a bulk delay value. In some examples, adaptive filter 242 may use signal 239 as a form of error signal to assist in the generation of acoustic feedback estimate 243. Examples of filters that may be included in adaptive filter 230 include, but are not necessarily limited to, finite impulse response (FIR) filters, infinite impulse response (IIR) filters, filters that use Bayesian statistics (e.g., Kalman filters), and any other type of filter.

The feedback system of FIG. 2 may produce an acoustic feedback estimate 243 which is closely modeled after acoustic feedback 230. Subtractor 238 may subtract the acoustic feedback estimate 243 from signal 235, thereby cancelling the effect of acoustic feedback 230 in signal 239. As the cancellation becomes ideal signal 239 may approach signal 235, which is a digital representation of input sound 226. When working properly, the information on error signal 239 is the desired sound information from input sound 226. Thus, the "error" nomenclature does not mean that the signal is purely error, but rather that its departure from the desired signal indicates error in the closed loop feedback system.

In any case, DSP 240 may process signal 239 based on one or more parameters. For instance, DSP 240 may amplify frequency bands in signal 239 by respective gain levels. As discussed above, the respective gain levels used by DSP 240 may be tailored to the specific hearing loss of the user of hearing aid 208. For instance, if DSP 240 has a first band that includes sounds below 500 Hz and a second band that includes sounds above 500 Hz, DSP 240 may be configured to amplify sounds in the first band by a greater gain level than sounds in the second band if the user of hearing aid 208 has more significant hearing loss below 500 Hz than above 500 Hz. While the previous example describes two bands, it follows that DSP may be configured to implement respective gain levels for larger quantities of frequency bands (e.g., 3, 4, 5, . . . , 10, . . . , 20, . . . , 40, etc.). The respective gain levels may be programmed via a programmer, such a programmer 106 of FIG. 1. As discussed above, it may be desirable for the gain levels used by DSP 240 to be below the maximum stable gain (MSG) of hearing aid 108 (e.g., as fitted to the user's ear). In any case, DSP 240 may output processed signal 241 to one or more components of hearing aid 108, such as D/A 236 and/or adaptive filter 242.

D/A 236 may convert processed signal 241 into analog processed signal 237, which is used to drive speaker(s) 224 to emit output sound 228. It is understood that various amplifier stages, filtering stages, and other signal processing stages are combinable with the present teachings without departing from the scope of the present subject matter. For instance, an amplifier or driver stage may be included between D/A 236 and speaker(s) 224.

Communication unit(s) 232 may be configured to communicate with one or more other devices. For instance, communication unit(s) 232 may be configured to communicate with a programmer (e.g., programmer 106 of FIG. 1) and/or another hearing aid, using radio frequency (RF) and/or inductive telemetry techniques known in the art, which may comprise techniques for proximal, mid-range, or longer-range communication. Communication unit(s) 232 may also communicate with other devices via a wired or wireless connection using any of a variety of local wireless communication techniques, such as RF communication according to the 802.11 or Bluetooth specification sets, infrared (IR) communication according to the IRDA specification set, or other standard or proprietary telemetry protocols. Communication unit(s) 232 may also communicate with other devices via exchange of removable media, such as magnetic or optical disks, memory cards, or memory sticks. Further, programmer 106 (FIG. 1) may communicate with hearing aids 108 and another programmer via remote telemetry techniques known in the art, communicating via a personal area network (PAN), a local area network (LAN), wide area network (WAN), public switched telephone network (PSTN), or cellular telephone network, for example.

Storage device(s) 244 within hearing aid 208 may store information for processing during operation of hearing aid 208. In some examples, storage device(s) may include a temporary memory, meaning that a primary purpose of storage component 248 is not long-term storage. Storage device(s) 244 may be configured for short-term storage of information as volatile memory and therefore not retain stored contents if powered off. Examples of volatile memories include random access memories (RAM), dynamic random access memories (DRAM), static random access memories (SRAM), and other forms of volatile memories known in the art.

Storage device(s) 244, in some examples, also include one or more computer-readable storage media. Storage device(s) 244 in some examples include one or more non-transitory computer-readable storage mediums. Storage device(s) 244 may be configured to store larger amounts of information than typically stored by volatile memory. Storage device(s) 244 may further be configured for long-term storage of information as non-volatile memory space and retain information after power on/off cycles. Examples of non-volatile memories include magnetic hard discs, optical discs, floppy discs, flash memories, or forms of electrically programmable memories (EPROM) or electrically erasable and programmable (EEPROM) memories.

In some examples, one or more of storage device(s) 244 may be standalone components. In some examples, one or more of storage device(s) 244 may be included in other components of hearing aid 208. For instance, one or more of storage device(s) 244 may be included in signal processor 222.

As discussed above, adaptive filter 230 may generate acoustic feedback estimate 243 based at least in part on one or more coefficients and/or a bulk delay value. In some examples, one or more of the coefficients and/or the bulk delay value may be adaptive. For instance, the bulk delay value may be set to an initial value and adaptive filter 230 may adjust the bulk delay value over time (i.e., to compensate for changes in acoustic feedback 230). In some examples, adaptive filter 230 may update one or more of the coefficients and/or the bulk delay value as described in U.S. Pat. No. 7,386,142, the entirety of which is hereby incorporated by reference. In some examples, the speed/rate at which adaptive filter 230 adapts the one or more of the coefficients and/or the bulk delay value (e.g., the adaptation speed/rate), may be adjustable. For instance, the adaptation rate may be adjusted by a clinician or a wearer of hearing aid 108 via a programmer, such as programmer 106 of FIG. 1.

Hearing aid 208 may be configured to perform one or more initialization activities, such as characterizing acoustic feedback 230, and estimating a MSG. In some examples, hearing aid 208 may perform the initialization activates without assistance from other devices. In some examples, hearing aid 208 may perform the initialization activates with assistance from one or more other devices, such as a programmer.

Figure 3:
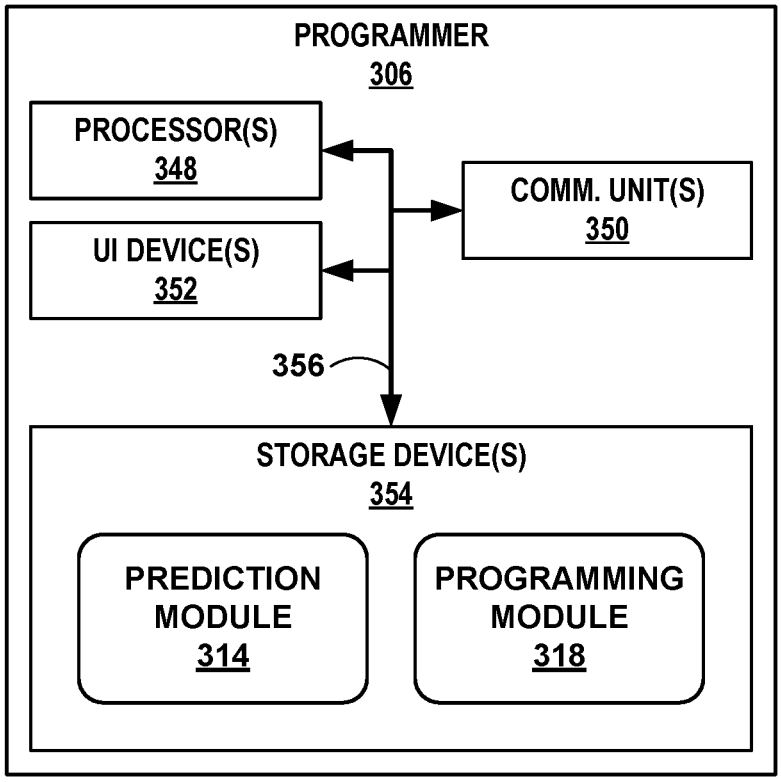
FIG. 3 is a block diagram illustrating an example programmer, in accordance with one or more aspects of the present disclosure.

FIG. 3 is a block diagram illustrating an example programmer, in accordance with one or more aspects of the present disclosure. Programmer 306 of FIG. 3 is described below as an example of programmer 106 of FIG. 1. FIG. 3 illustrates only one particular example of programmer 106, and many other examples of programmer 306 may be used in other instances and may include a subset of the components included in example programmer 306 or may include additional components not shown in FIG. 3. For instance, programmer 306 may include a battery or other power source configured to provide power to one or more components of programmer 306.

As illustrated in FIG. 3, programmer 306 may include one or more processors 348, one or more communication units 350, one or more user interface (UI) devices 352, and one or more storage devices 254. Each of components 348, 350, 352, and 354 may be interconnected (physically, communicatively, and/or operatively) via communication channels 356 for inter-component communications. In some examples, communication channels 356 may include a system bus, network connection, interprocess communication data structure, or any other channel for communicating data. One or more of storage devices 354, in some examples, may include prediction module 314 and programming module 318.

Processors 348, in one example, are configured to implement functionality and/or process instructions for execution within programmer 306. For example, processors 348 may be capable of processing instructions stored in one or more of storage devices 36. Examples of processors 348 may include any one or more microprocessors, digital signal processors (DSPs), application specific integrated circuits (ASICs), field programmable gate arrays (FPGAs), or any other equivalent integrated or discrete logic circuitry, as well as any combinations of such components.

Communication unit(s) 350 may be configured to communicate with hearing aids (e.g., hearing aids 108 of FIG. 1, hearing aid 208 of FIG. 2) and, optionally, another computing device, via wired or wireless communication. Communication unit(s) 350, for example, may communicate with hearing aids using radio frequency (RF) and/or inductive telemetry techniques known in the art, which may comprise techniques for proximal, mid-range, or longer-range communication. Communication unit(s) 350 may also communicate with another programmer or computing device via a wired or wireless connection using any of a variety of local wireless communication techniques, such as RF communication according to the 802.11 or Bluetooth specification sets, infrared (IR) communication according to the IRDA specification set, or other standard or proprietary telemetry protocols. Communication unit(s) 350 may also communicate with other programming or computing devices via exchange of removable media, such as magnetic or optical disks, memory cards, or memory sticks. Further, communication unit(s) 350 may communicate with hearing aids and another programmer via remote telemetry techniques known in the art, communicating via a personal area network (PAN), a local area network (LAN), wide area network (WAN), public switched telephone network (PSTN), or cellular telephone network, for example.

Programmer 306, in some examples, may also include one or more UI devices 352. In some examples, one or more of UI devices 352 can be configured to output content, such as video content. In addition to outputting content, one or more of UI devices 352 may be configured to receive tactile, audio, or visual input. Some examples of UI devices 352 include video displays, speakers, keyboards, touch screens, mice, cameras, and the like.

One or more storage devices 354 may be configured to store information within programmer 306 during operation. One or more of storage devices 354, in some examples, may comprise a computer-readable storage medium. In some examples, one or more of storage devices 354 may comprise a temporary memory, meaning that a primary purpose of one or more of storage devices 354 is not long-term storage. One or more of storage devices 354, in some examples, may comprise a volatile memory, meaning that one or more of storage devices 354 does not maintain stored contents when the system is turned off. Example of volatile memories include random access memories (RAM), dynamic random access memories (DRAM), static random access memories (SRAM), and other forms of volatile memories known in the art. In some examples, one or more of storage devices 354 is used to store program instructions for execution by processors 348. One or more of storage devices 354, in one example, may be used by software or modules running on source device 4 (e.g., prediction module 314, and programming module 318) to temporarily store information during program execution.

One or more of storage devices 354, in some examples, may also include one or more computer-readable storage media. One or more of storage devices 354 may further be configured for long-term storage of information. In some examples, one or more of storage devices 354 may include non-volatile storage elements. Examples of such non-volatile storage elements include magnetic hard discs, optical discs, floppy discs, flash memories, or forms of electrically programmable memories (EPROM) or electrically erasable and programmable (EEPROM) memories.

Programming module 318 may be configured to perform functions similar to programming module 118 of FIG. 1. For instance, programming module 318 may be configured to cause communication unit(s) 350 to communicate with a hearing aid in order to store values for one or more parameters, cause the hearing aid to perform one or more initialization activities, assist the hearing aid in the performance of one or more initialization activities, and the like.

As discussed above and in accordance with one or more techniques of this disclosure, prediction module 314 may be configured to predict a feedback cancelation configuration for a current hearing aid based on feedback cancelation configurations of a plurality of other hearing aids. For instance, prediction module 314 may predict an initial bulk delay value for a hearing aid based on bulk delay values of a plurality of other hearing aids.

In some examples, the feedback cancelation configuration of a hearing aid may be dependent on one or more properties of the hearing aid. For instance, the bulk delay of a hearing aid may be dependent on one or more of: a type of the hearing aid (e.g., CIC, BTE, ITC, etc.), a vent size of the hearing aid (i.e., a size of the vent that allows air to flow between the outside and the ear canal), properties of an earmold of the hearing aid (e.g., material, fit, insertion depth, receiver type), etc.

In accordance with one or more techniques of this disclosure, prediction module 314 may be configured to predict a feedback cancelation configuration for a current hearing aid based on feedback cancelation configurations of a plurality of other hearing aids having the same properties as the current hearing aid. For instance, prediction module 314 may determine values for one or more properties of the hearing aid (e.g., one or more physical properties of the hearing aid and/or one or more properties of a digital signal processor (DSP) of the hearing aid).

Prediction module 314 may obtain, based on the determined values for the one or more properties, a predicted initial feedback cancelation configuration for the current hearing aid. In some examples, prediction module 314 may locally obtain the predicted initial feedback cancelation configuration for the current hearing aid (i.e., determine the predicted initial feedback cancelation configuration for the current hearing aid based on data stored by storage device(s) 354). In some examples, prediction module 314 may obtain the predicted initial feedback cancelation configuration for the current hearing aid with the assistance of one or more remote devices, such as server system 104 of FIG. 1. In particular, prediction module 314, upon execution by a processor 348, may output a message that indicates the values of the properties, and receive a response that indicates predicted initial feedback cancelation configuration for the current hearing aid.

The predicted initial feedback cancelation configuration for the current hearing aid may include one or more parameters. As one example, the predicted initial feedback cancelation configuration may include an a priori probability distribution of feedback canceler coefficients which can be used by feedback cancelers that use Bayesian statistics. As another example, the predicted initial feedback cancelation configuration may include an estimate of a bulk delay. As another example, the predicted initial feedback cancelation configuration may include a priori feedback canceler coefficients that can be used as a basis for feedback canceler adaptation. For instance, where a feedback canceler includes a filter having zeros and poles, the predicted initial feedback cancelation configuration may include the poles and the zeros may be adapted.

Programming module 318 may program the current hearing aid based at least in part on the predicted initial feedback configuration. For instance, programming module 318 may cause communication units 350 to transmit a predicted initial bulk delay value to the current hearing aid.

As discussed above, programming module 318 may cause the hearing aid to perform one or more initialization activities and/or assist the hearing aid in the performance of one or more initialization activities. For instance, when a clinician is using programmer 306 to fit a first hearing aid to a patient's left ear and a second hearing aid to a patient's right ear, programming module 318 may cause the first hearing aid to estimate a maximum stable gain (MSG) for the first hearing aid and cause the second hearing aid to estimate a MSG for the second hearing aid. In some examples, it may be desirable for a clinician to validate the MSG estimates.

In accordance with one or more techniques of this disclosure, prediction module 314 may determine whether the MSG estimates are valid based on differences between MSG estimates of corresponding left-right pairs of a plurality of other hearing aids. For instance, prediction module 314 may obtain a threshold MSG difference determined based on the differences between MSG estimates of corresponding left-right pairs of a plurality of other hearing aids. The threshold MSG difference may represent an amount of variation between MSGs of corresponding left-right hearing aids before which the estimated MSGs are not likely valid. For instance, the threshold MSG difference may be a difference between MSGs of corresponding left-right hearing aids. If a difference between the estimated MSG for the first hearing aid and the second hearing aid is less than or equal to the threshold difference, prediction module 314 may determine that the estimated MSGs are valid. In response to determining the estimated MSGs are valid, prediction module 314 may cause one or more of UI devices 352 to output a confirmation of the validity. For instance, prediction module 314 may cause a display of UI devices 352 to output a visual confirmation (e.g., display a graphical user interface that includes an indication that the estimated MSGs are valid), a speaker of UI devices 352 to output an audio confirmation, and/or cause a haptic feedback device of UI devices 352 to output a haptic confirmation.

Similarly, if the difference between the estimated MSG for the first hearing aid and the second hearing aid is greater than the threshold difference, prediction module 314 may determine that one or both of the estimated MSGs is not valid. In response to determining the one or both of the estimated MSGs is not valid, prediction module 314 may cause one or more of UI devices 352 to output a warning. For instance, prediction module 314 may cause a display of UI devices 352 to output a visual warning (e.g., display a graphical user interface that includes an indication that the estimated MSGs are not valid), a speaker of UI devices 352 to output an audio warning, and/or cause a haptic feedback device of UI devices 352 to output a haptic warning. In this way, programmer 306 may inform the clinician of potential issues with the feedback cancelation configuration of the hearing aid, which may improve patient outcomes.

Additionally, in some examples, prediction module 314 may predict a MSG of a current hearing aid (without having to initialize the current hearing aid) based on MSGs of previously initialized hearing aids having the same or similar properties as the current hearing aid. Prediction module 314 may utilize the predicted MSG to inform the clinician of possible feedback issues. For instance, prediction module 314 may cause one or more of UI devices 352 to output a warning when the predicted MSG may cause feedback issues. In some examples, prediction module 314 may determine that the predicted MSG may cause feedback issues by comparing the predicted MSG to the actual gain in the hearing aid). For example, if the predicted MSG is less than the actual programmed gain, prediction module 314 may determine the predicted MSG may cause feedback issues.

Even if a hearing aid does not exhibit feedback issues during the fitting procedure, it may still be possible for feedback issues to emerge in the field during use by a patient. The later emergence of feedback issues may be undesirable in that the patient may have to return to the clinician or suffer from the effects of feedback.

In accordance with one or more techniques of this disclosure, prediction module 314 may predict whether a current hearing aid will develop feedback issues based on data collected during fittings of other hearing aids. For instance, data on MSG, gain, and multiple clinician visits (or other indications of feedback issues) can be used to train a machine learning algorithm to predict whether hearing aids will experience feedback in the field. Prediction module 314 may utilize such a machine learning algorithm to determine whether a current hearing aid is likely to experience feedback in the field. In response to determining that the current hearing aid is likely to experience feedback in the field, prediction module 314 may inform the clinician. For instance, prediction module 314 may cause one or more of UI devices 352 to output a warning that the current hearing aid is likely to experience feedback in the field.

In some examples, it may not be desirable to automatically program the feedback cancelation loop of a current hearing aid with the predicted initial feedback cancelation configuration. For instance, a clinician may be accustomed to fitting hearing aids in a certain manner that involves causing hearing aids to perform initialization operations. As such, in accordance with one or more techniques of this disclosure, prediction module 314 may be used to validate one or more parameters of an estimated initial feedback cancelation configuration generated by a current hearing aid. For instance, programming module 318 may cause the current hearing aid to generate an estimated initial feedback cancelation configuration. Prediction module 314 may compare the estimated initial feedback cancelation configuration with a predicted initial feedback cancelation configuration obtained for the current hearing aid. If the difference between a parameter of the estimated initial feedback cancelation configuration and a corresponding parameter of the predicted initial feedback cancelation configuration is greater than a threshold difference, prediction module 314 may cause one or more of UI devices 352 to output a warning. For instance, prediction module 314 may cause a display of UI devices 352 to output a visual warning (e.g., display a graphical user interface that includes an indication that the estimated parameter is not valid), a speaker of UI devices 352 to output an audio warning, and/or cause a haptic feedback device of UI devices 352 to output a haptic warning. In this way, programmer 306 may inform the clinician of potential issues with the feedback cancelation configuration of the hearing aid, which may improve patient outcomes.

Prediction module 314 may, in some examples, utilize parameter settings (such as adaptation speed or OPM rate) from other hearing aids to predict missing parameter settings for the current hearing aid. For instance, if each set of hearing aid configuration data is represented as a row in a table with a column for each parameter, prediction module 314 may utilize a matrix completion algorithm to predict values of missing parameters. As one example, using adaptation speed (or OPM rate) and amount of available gain margin data (i.e., difference between gain level setting and MSG) from other hearing aids, prediction module 314 may predict an adaptation speed (or OPM rate) for a current hearing aid based on the amount of available gain margin for the current hearing aid. Prediction module 314 may cause one or more of UI devices 352 to output an indication of the predicted value(s) of the missing parameters for the current hearing aid.

The clinician may utilize programmer 306 to configure one or more gain levels of the current hearing aid. For instance, the clinician may tailor the gain levels of the current hearing aid based on the specific hearing requirements of the patient. As discussed above, hearing aids, such as hearing aids 108 of FIG. 1 and hearing aid 208 of FIG. 2, may process sound using a plurality of bands (also known as channels) that are each amplified using a respective gain level, and it may be desirable for the gain level in each band to be less than a MSG of the respective band. As also discussed above, by programming the current hearing aid with a more accurate initial feedback cancelation configuration, programmer 306 may improve the performance of the feedback cancelation loop. As the performance of the feedback cancelation loop improves, the closed-loop (i.e., when the feedback cancelation loop is enabled) MSGs of the hearing aid may increase. As the MSGs increase, the gain levels used by the hearing aid may corresponding increase without causing feedback. In this way, programmer 306 may improve patient outcomes.

In some examples, programmer 306 may utilize data logged during initialization of feedback cancelers of other hearing aids to increase the probability that initialization of a feedback canceler of a current hearing aid will be successful (i.e., result in valid parameters). For instance, prediction module 314 may use a correlation between success rate and hearing aid type, vent size, background noise, etc. to determine settings that are likely to result in a successful initialization of a feedback canceler. In other words, prediction module 314 may obtain, based on initialization settings used during initialization of a plurality of other hearing aids having similar properties as the current hearing aid, predicted initialization settings for the current hearing aid.

Programmer 306 may to inform the clinician or customize the feedback canceler initialization, such as using a longer initialization time and/or using a different stimulus signal (i.e., the sound emitted by speakers of the hearing aid during initialization). As one example, prediction module 314 may cause one or more of UI devices 352 to output an indication of the predicted initialization settings (e.g., a graphical user interface that indicates the initialization time needed and/or the recommended stimulus signal). As another example, programmer 306 may cause the current hearing aid to initialize using the predicted initialization settings. In this way, programmer 306 may increase the probability that initialization of the feedback canceler of the current hearing aid will be successful.

Figure 4:
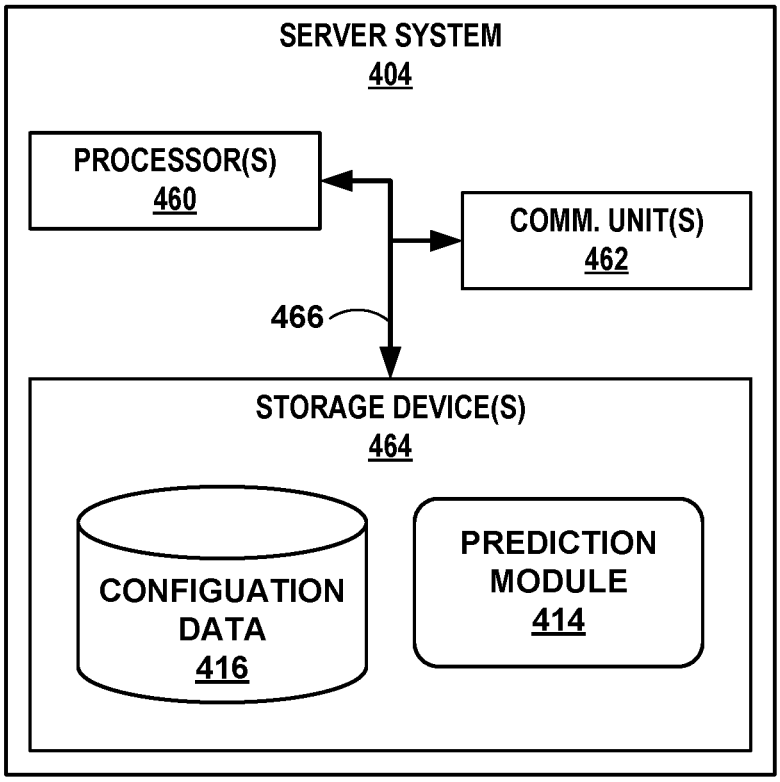
FIG. 4 is a block diagram illustrating an example server system for predicting feedback cancelation configurations, in accordance with one or more aspects of the present disclosure.

FIG. 4 is a block diagram illustrating an example server system for predicting feedback cancelation configurations, in accordance with one or more aspects of the present disclosure. Server system 404 of FIG. 4 is described below as an example of server system 404 of FIG. 1. FIG. 4 illustrates only one particular example of server system 404, and many other examples of server system 404 may be used in other instances and may include a subset of the components included in example server system 404 or may include additional components not shown in FIG. 4. For instance, server system 404 may include one or more user interface devices.

As illustrated in FIG. 4, server system 404 may include one or more processors 460, one or more communication units 462, and one or more storage devices 464. Each of components 460, 462, and 464 may be interconnected (physically, communicatively, and/or operatively) via communication channels 466 for inter-component communications. In some examples, communication channels 466 may include a system bus, network connection, interprocess communication data structure, or any other channel for communicating data. One or more of storage devices 464, in some examples, may include prediction module 414 and configuration data 416.

Processors 460, in one example, are configured to implement functionality and/or process instructions for execution within server system 404. For example, processors 460 may be capable of processing instructions stored in one or more of storage devices 36. Examples of processors 460 may include any one or more microprocessors, digital signal processors (DSPs), application specific integrated circuits (ASICs), field programmable gate arrays (FPGAs), or any other equivalent integrated or discrete logic circuitry, as well as any combinations of such components.

Communication unit(s) 462 may be configured to communicate with programmers, and, optionally, another computing device, via wired or wireless communication. Communication unit(s) 462 may communicate with a programmer or other computing device via a wired or wireless connection using any of a variety of local wireless communication techniques, such as RF communication according to the 802.11 or Bluetooth specification sets, infrared (IR) communication according to the IRDA specification set, or other standard or proprietary telemetry protocols. Communication unit(s) 462 may also communicate with other programming or computing devices via exchange of removable media, such as magnetic or optical disks, memory cards, or memory sticks. Further, communication unit(s) 462 may communicate with hearing aids and another programmer via remote telemetry techniques known in the art, communicating via a personal area network (PAN), a local area network (LAN), wide area network (WAN), public switched telephone network (PSTN), or cellular telephone network, for example.

One or more storage devices 464 may be configured to store information within server system 404 during operation. One or more of storage devices 464, in some examples, may comprise a computer-readable storage medium. In some examples, one or more of storage devices 464 may comprise a temporary memory, meaning that a primary purpose of one or more of storage devices 464 is not long-term storage. One or more of storage devices 464, in some examples, may comprise a volatile memory, meaning that one or more of storage devices 464 does not maintain stored contents when the system is turned off. Example of volatile memories include random access memories (RAM), dynamic random access memories (DRAM), static random access memories (SRAM), and other forms of volatile memories known in the art. In some examples, one or more of storage devices 464 is used to store program instructions for execution by processors 460. One or more of storage devices 464, in one example, may be used by software or modules running on source device 4 (e.g., prediction module 314) to temporarily store information during program execution.

One or more of storage devices 464, in some examples, may also include one or more computer-readable storage media. One or more of storage devices 464 may further be configured for long-term storage of information. In some examples, one or more of storage devices 464 may include non-volatile storage elements. Examples of such non-volatile storage elements include magnetic hard discs, optical discs, floppy discs, flash memories, or forms of electrically programmable memories (EPROM) or electrically erasable and programmable (EEPROM) memories.

Prediction module 414 may be configured to perform functions similar to prediction module 114 of FIG. 1 and prediction module 314 of FIG. 3. For instance, prediction module 414 may be configured to, upon execution by one or more processors 460, predict a feedback cancelation configuration for a current hearing aid based on feedback cancelation configurations of a plurality of other hearing aids having the same properties as the current hearing aid. In some examples, prediction module 414 may utilize one or more machine learning algorithms to predict the feedback cancelation configuration for the current hearing aid. For instance, prediction module 414 may receive, via communication units 462 or from configuration data 416, feedback cancelation configurations of a plurality of hearing aids from programmers of the plurality of hearing aids. Prediction module 414 may then use a machine learning algorithm trained based on the received feedback cancelation configurations to predict the feedback cancelation configuration for the current hearing aid.

While described as being included in different devices, any of the functionality described with respect to prediction module 414 of FIG. 4 may be performed by prediction module 314 of FIG. 3, and vice versa. For instance, prediction module 314 of FIG. 3 may utilize one or more machine learning algorithms to predict the feedback cancelation configuration for the current hearing aid.

Figure 5A:
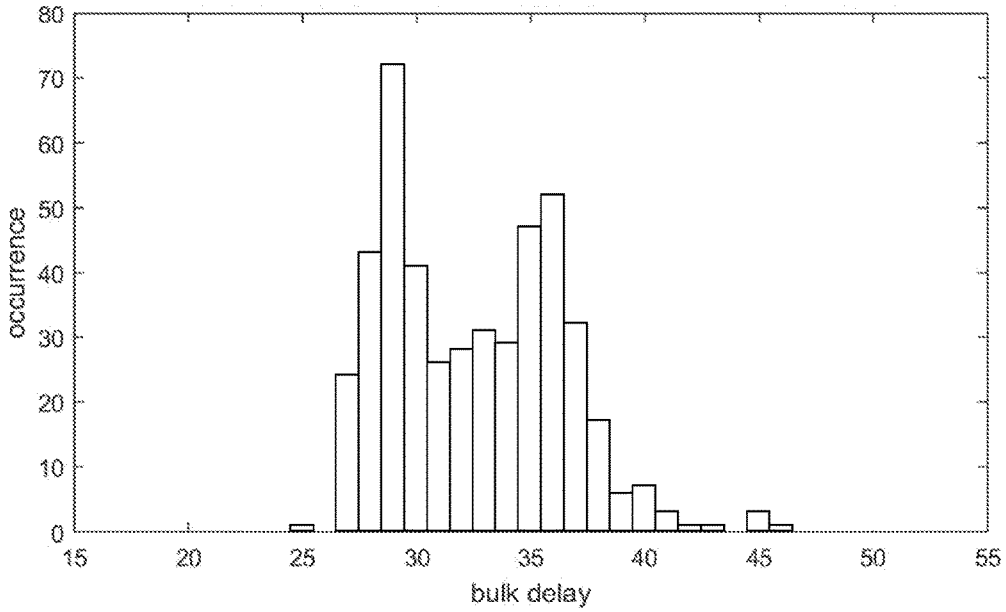
FIGS. 5A and 5B are histograms illustrating distributions of bulk delay values of hearing aids, in accordance with one or more techniques of this disclosure.
Figure 5B:
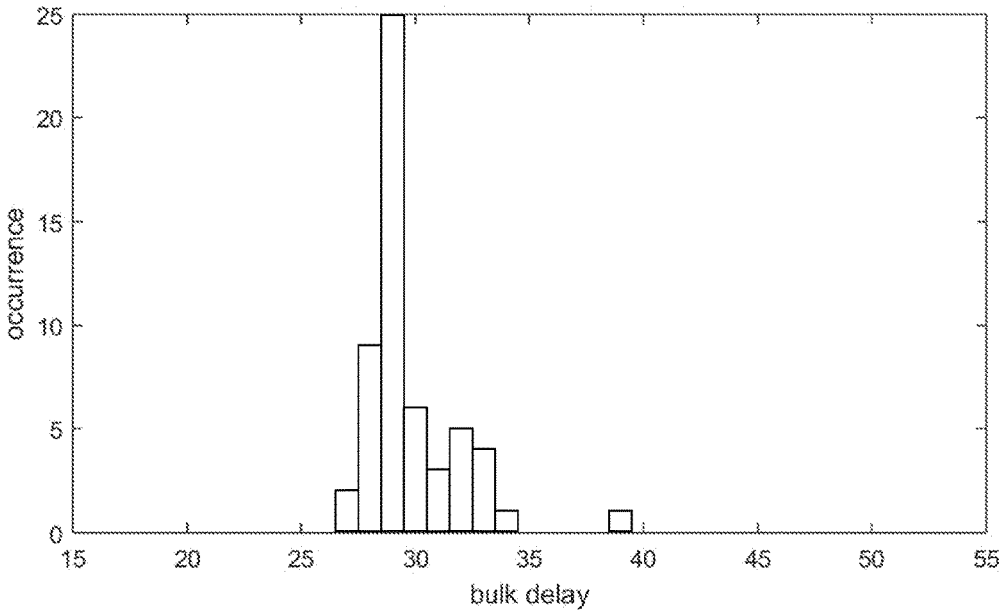

FIGS. 5A and 5B are histograms illustrating distributions of bulk delay values of hearing aids, in accordance with one or more techniques of this disclosure. FIG. 5A illustrates a distribution of bulk delay values for a plurality of hearing aid types, such as BTE, CIC, RIC, etc. As can be observed from FIG. 5A, the bulk delay values vary from 25 to 46 with distinct peaks at 29 and 36.

FIG. 5B illustrates a distribution of bulk delay values for a single type of hearing aid (e.g., DISC). As can be observed from FIG. 5B, the distribution for the single type of hearing aid is narrower than the distribution for the plurality of hearing aid types. In particular, the bulk delay values of FIG. 5B range from 27 to 34 with a single outlier at 39.

As discussed above an in accordance with one or more techniques of this disclosure, a device (e.g., a programmer or a server system) may predict a feedback configuration for a hearing aid based on feedback configurations of other hearing aids with similar properties. For instance, without initializing a DISC hearing aid, a device may predict a bulk delay value of 29 for the DISC hearing aid based on the data represented by FIG. 5B. As discussed above, the predicted bulk delay value may be fixed or may be an initial bulk delay values used in an adaptive filter.

Additionally, if the DISC hearing aid is fitted with initialization and the bulk delay estimated during initialization is unusually high (for instance the outlier 39), a programmer (e.g., programmer 106 of FIG. 1 or programmer 306 of FIG. 3) may re-do the initialization or may output an indication that the estimated bulk delay does not appear to be valid. For instance, the programmer may output a request for the clinician to verify the placement of the DISC hearing aid.

As the data set illustrated in FIG. 5A contains feedback cancelation configurations from 465 initializations, 56 of which are for DISC devices, any predictions based on the data set may not have a high confidence (e.g., it may not be possible to confidently determine whether 39 is an outlier). However, the larger the data set used to predict the feedback cancelation configurations, the higher the confidence in the predictions. Additionally, increased data set sizes may enable the consideration of additional properties (i.e., beyond hearing aid type), such as vent size.

The value of this predicted (i.e., a priori) bulk delay can be evaluated by comparing the Maximum Stable Gain (MSG) using the predicted value for the bulk delay of the DISC hearing aids to the MSG using the predicted value for the bulk delay of all hearing aids. Example results of such a comparison are discussed below with reference to FIGS. 6A and 6B.

Figure 6A:
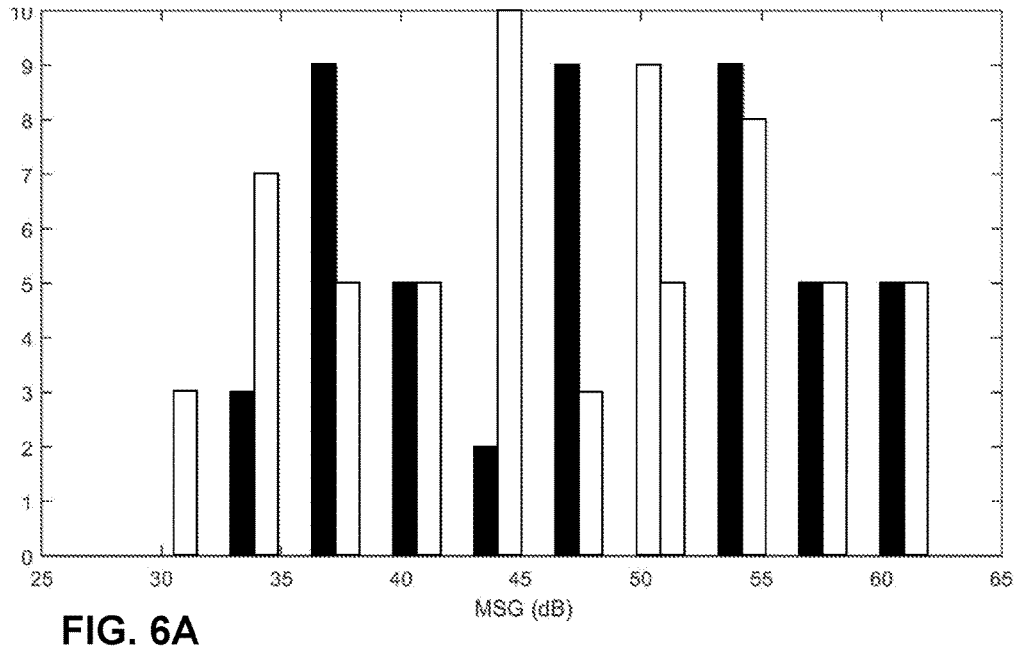
FIGS. 6A and 6B are graphs illustrating maximum stable gains (MSGs) of hearing aids, in accordance with one or more techniques of this disclosure.
Figure 6B:
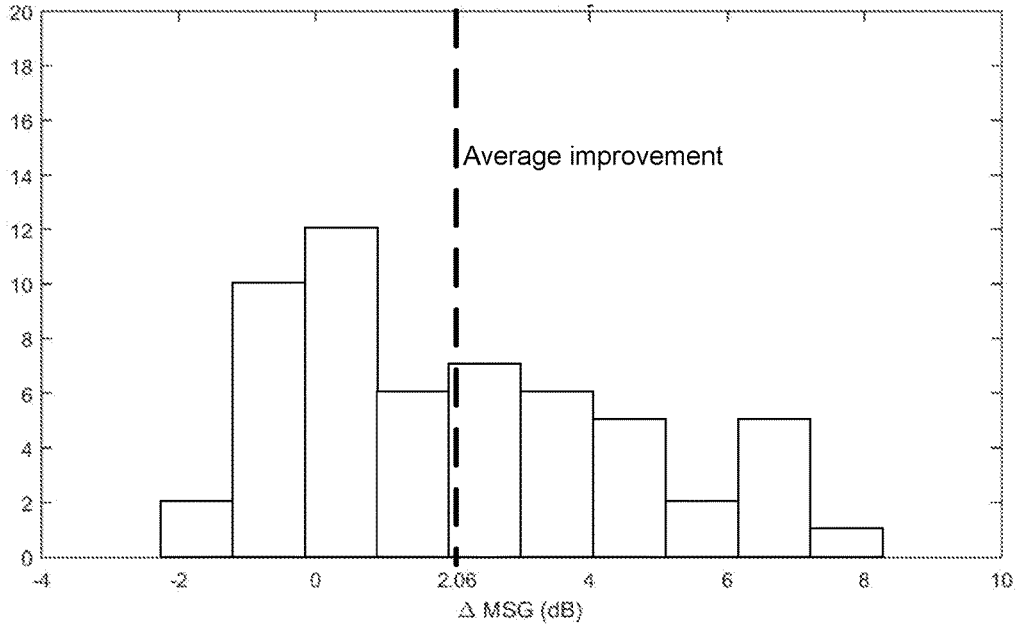

FIGS. 6A and 6B are graphs illustrating maximum stable gains (MSGs) of hearing aids, in accordance with one or more techniques of this disclosure. FIG. 6A illustrates a distribution of MSGs using predicted bulk delay values of DISC hearing aids and a distribution of MSGs using predicted bulk delay values of all hearing aid types. FIG. 6B illustrates a distribution of differences in MSGs between using predicted bulk delays in DISC hearing aids relative to predicted bulk delays of all hearing aid types. As shown in FIG. 6B, predicting the bulk delay of a DISC hearing aid based on bulk delays of other DISC hearing aids results in an MSG that is on average 2 dB better than predicting the bulk delay of a DISC hearing aid based on bulk delays of all hearing aid types.

Figure 7A:
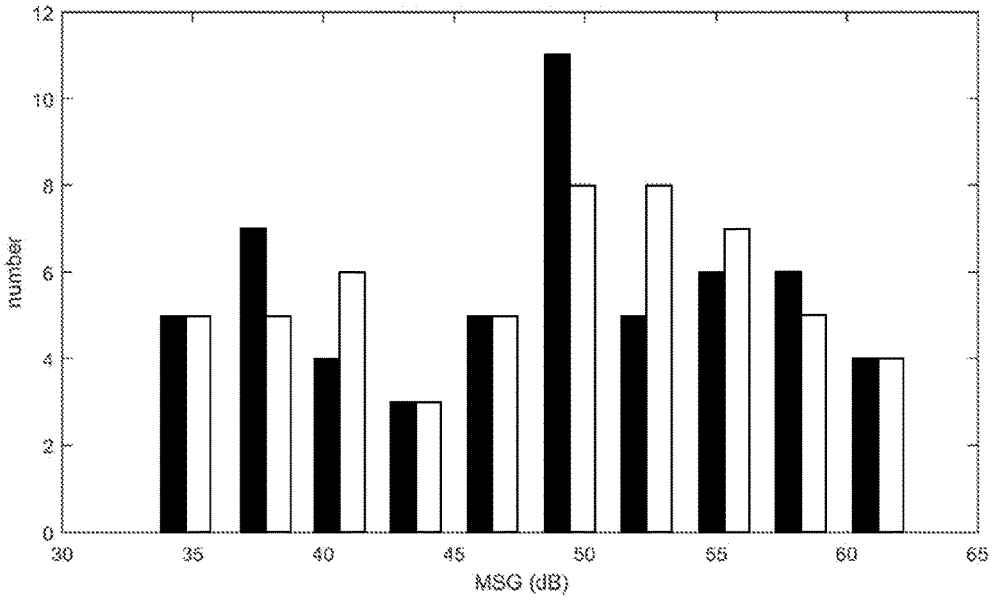
FIGS. 7A and 7B are histograms illustrating maximum stable gains (MSGs) of hearing aids, in accordance with one or more techniques of this disclosure.
Figure 7B:
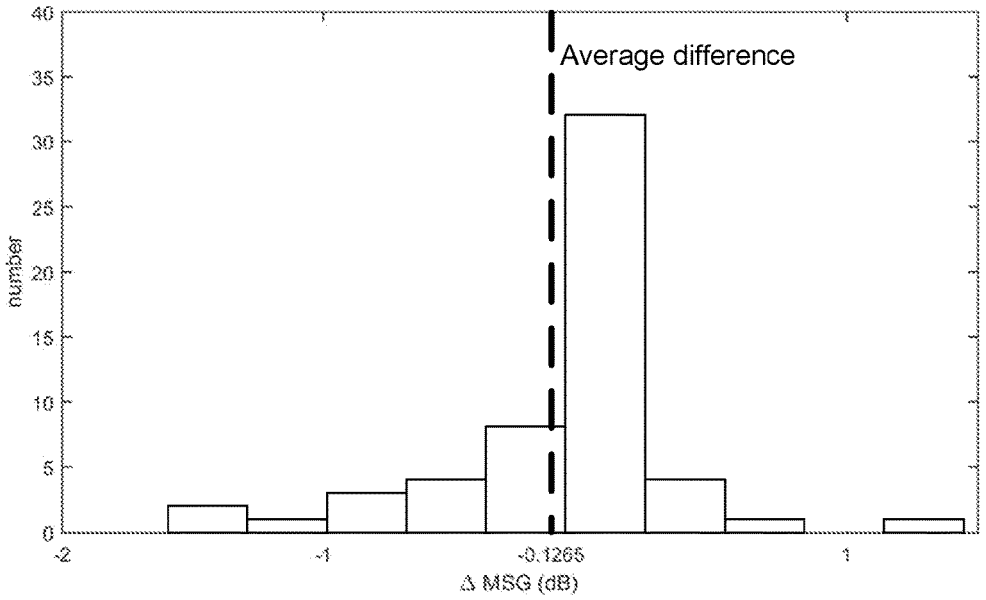

FIGS. 7A and 7B are histograms illustrating maximum stable gains (MSGs) of hearing aids, in accordance with one or more techniques of this disclosure. FIG. 7A illustrates a distribution of MSGs of DISC hearing aids using bulk delays predicted based on bulk delays of other DISC hearing aids (shaded bars) and a distribution of MSGs of DISC hearing aids using bulk delays estimated during initialization (unshaded bars). FIG. 7B illustrates a distribution of MSG differences between DISC hearing aids using bulk delays predicted based on bulk delays of other DISC hearing aids and bulk delays estimated during initialization. As can be observed from FIGS. 7A and 7B, using bulk delay predicted based on bulk delays of other DISC hearing aids results in a very small degradation (on average −0.13 dB). As such, a predicted bulk delay value may be considered to be almost as good as a bulk delay value estimated during initialization.

Figure 8A:
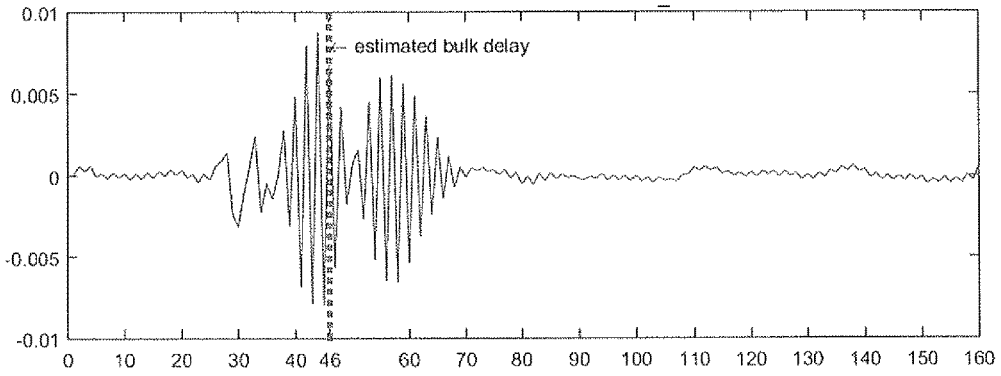
FIGS. 8A-8C are graphs illustrating signals of a hearing aid, in accordance with one or more techniques of this disclosure
Figure 8B:
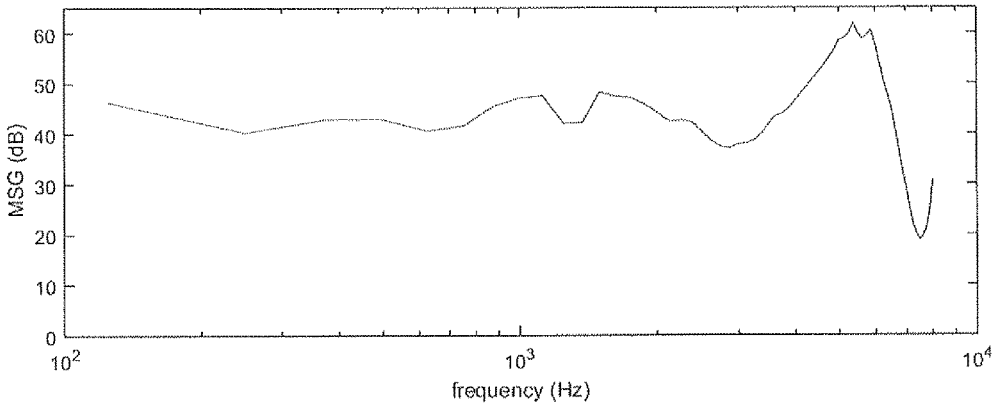
Figure 8C:
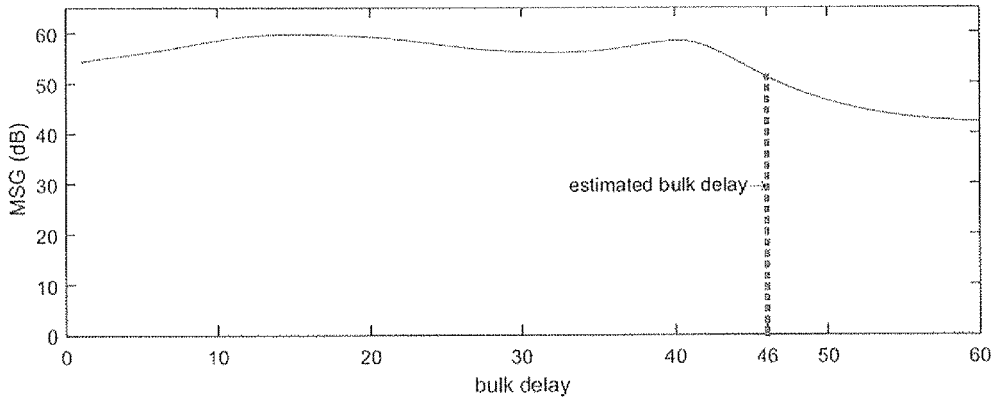

FIGS. 8A-8C are graphs illustrating signals of a hearing aid, in accordance with one or more techniques of this disclosure. As discussed above and in accordance with one or more techniques of this disclosure, a device, such as programmer 306 of FIG. 3, may be used to validate one or more parameters of an estimated initial feedback cancelation configuration generated by a current hearing aid. FIGS. 8A-8C provide an example of how a device may determine whether a parameter of an estimated initial feedback cancelation configuration is valid. Specifically, FIG. 8A illustrates an impulse response of a hearing aid, such as hearing aid 208 of FIG. 2, and a bulk delay estimated based on said impulse response. As can be observed from FIG. 8A, the impulse response has two distinct peaks, which may be uncommon.

As discussed above, a hearing aid may include a filter, such as adaptive filter 230, to provide feedback cancelation. The adaptive filter may attempt to model the feedback path as best as possible. In some examples, it may require a large amount of computational power if the adaptive filter were to attempt to model the feedback path from a first tap of the filter. As such, in some examples, the adaptive filter may utilize a bulk delay to delay the input of the filter (i.e., signal 241 in FIG. 2) such that adaptive filter skips the first small taps of the impulse response and only models the part of the impulse response with the largest response. For instance, as shown in FIG. 8A, the largest acoustic feedback path is roughly between taps 30 and 70.

FIG. 8B illustrates the maximum stable gain (MSG) of the hearing aid with the feedback canceler off (i.e., open-loop). As can be observed from FIG. 8B, the MSG is fairly flat with a peak at 5.5. kHz. Such a peak may be uncommon. Typically, an open-loop MSG has the shape of a "bathtub" with high MSG at low frequencies (i.e., less than 1 kHz) and high frequencies (i.e., 4 kHz), and low MSG between the low frequencies and the high frequencies (i.e., between 1 kHz and 4 kHz).

FIG. 8C illustrates the MSG of the hearing aid at 2 kHz with the feedback canceler enabled (i.e., closed-loop) for different values of the bulk delay. As can be observed from FIG. 8C, the maximum MSG does not coincide with the estimated bulk delay (46). Instead, the maximum MSG coincides with a bulk delay of approximately 15. As such, the unusually high estimate of the bulk delay is an indication that the initialization may be invalid. Therefore, the device (e.g., programmer 306) may output a warning to the clinician to re-do the initialization (including replacing the measurement). It should be noted that both the bulk delay, the impulse response, and the open-loop MSG (which may be the inverse of the transfer function of the impulse response) can be used for this detection.

Figure 9:
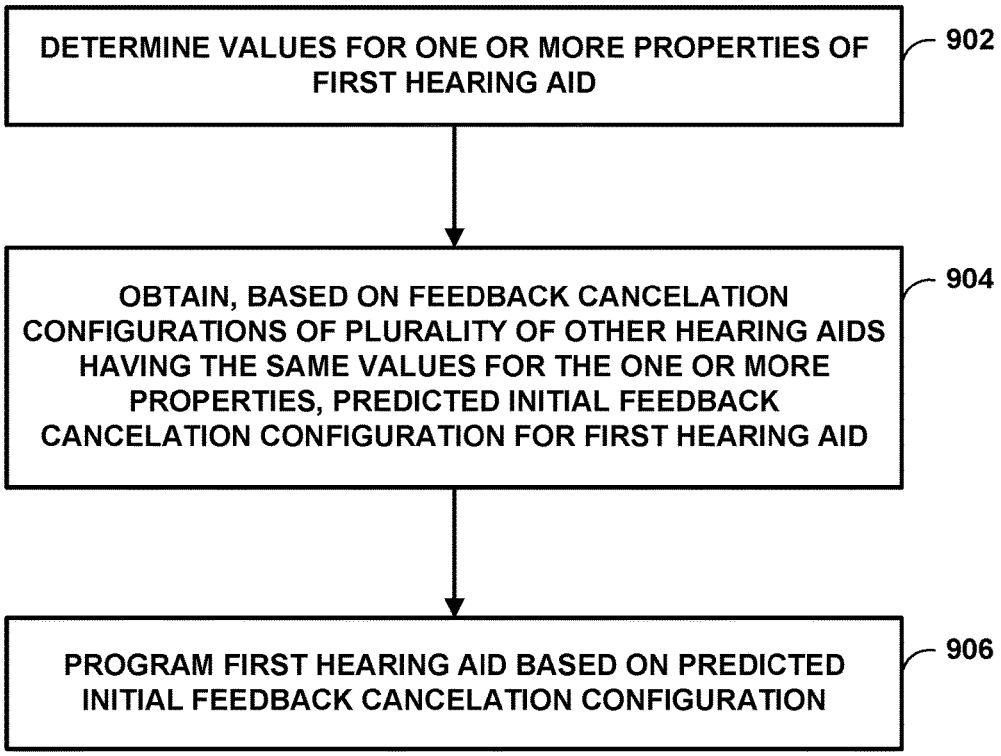
FIG. 9 is a flowchart illustrating example operations performed to predict a feedback cancelation configuration for a hearing aid, in accordance with one or more aspects of the present disclosure.

FIG. 9 is a flowchart illustrating example operations performed to predict a feedback cancelation configuration for a hearing aid, in accordance with one or more aspects of the present disclosure. The techniques of FIG. 9 may be performed by one or more processors of a device, such as programmer 106 illustrated in FIG. 1 or programmer 306 illustrated in FIG. 3. For purposes of illustration, the techniques of FIG. 9 are described within the context of programmer 106 illustrated in FIG. 1 or programmer 306 illustrated in FIG. 3, although computing devices having configurations different than that of programmer 106 or programmer 306 may perform the techniques of FIG. 9. For instance, server system 104 of FIG. 1 or server system 404 of FIG. 4 may perform all or a portion of the techniques of FIG. 9.

Programmer 306 may determine values for one or more properties of a first hearing aid (1002). In some examples, programmer 306 may receive one of more of the values via a communication link with the first hearing aid. In some examples, a clinician may provide one or more of the values via a user interface of programmer 306. As discussed above, the properties may include, but are not limited to, physical properties of the first hearing aid (e.g., model information, vent size, or properties of an earmold of the first hearing aid) and properties of a digital signal processor (DSP) of the first hearing aid (e.g., amount of gain, number of frequency channels, directionality of hearing aid, etc.). The values determined by programmer 306 for the one or more properties of the first hearing aid may be numerical values, text values, other value types, or some combination of numerical text and other.

Programmer 306 may obtain, based on feedback cancelation configurations of a plurality of other hearing aids having the same values for the one or more properties as the first hearing aid, a predicted initial feedback cancelation configuration for the first hearing aid (1004). For instance, one or more of processors 348 of programmer 306 may execute prediction module 314 of programmer 306 to obtain a predicted initial bulk delay value of a feedback cancelation loop of the first hearing aid. As discussed above, in some examples, prediction module 314 may locally obtain the predicted initial feedback cancelation configuration for the current hearing aid (i.e., determine the predicted initial feedback cancelation configuration for the current hearing aid based on data stored by storage device(s) 354 of programmer 306). In some examples, prediction module 314 may obtain the predicted initial feedback cancelation configuration for the current hearing aid with the assistance of one or more remote devices, such as server system 104 of FIG. 1. In particular, prediction module 314 may output a message that indicates the values of the properties, and receive a response that indicates predicted initial feedback cancelation configuration for the current hearing aid.

Programmer 306 may program the first hearing aid based on the predicted initial feedback cancelation configuration (1006). For instance, one or more of processors 348 may execute programming module 318 of programmer 306 to communicate with the first hearing aid to store the predicted parameters in a storage device of the hearing aid.

The following numbered examples may illustrate one or more aspects of the disclosure:

Example 1

A method comprising: determining, by one or more processors of a hearing aid programmer, values for one or more properties of a first hearing aid; obtaining, by the one or more processors, based on feedback cancelation configurations of a plurality of other hearing aids having the same values for the one or more properties as the first hearing aid, a predicted initial feedback cancelation configuration for the first hearing aid; and programming, by the one or more processors, the first hearing aid based on the predicted initial feedback cancelation configuration.

Example 2

The method of example 1, wherein the predicted initial feedback cancelation configuration comprises a predicted initial bulk delay value of a feedback cancelation loop of the first hearing aid.

Example 3

The method of any combination of examples 1-2, wherein the predicted initial bulk delay value is a predicted initial bulk delay value for the first hearing aid, the method further comprising: initializing, while the first hearing aid is fitted to an ear of a particular patient, the feedback cancelation loop of the first hearing aid to estimate a maximum stable gain (MSG) for the first hearing aid; initializing, while a second hearing aid is fitted to another ear of the particular patient, a feedback cancelation loop of the second hearing aid to estimate an MSG for the second hearing aid; and responsive to determining that a difference between the MSG for the first hearing aid and the MSG for the second hearing aid is greater than a threshold MSG difference that is determined based on differences between MSGs of corresponding left-right pairs of the plurality of other hearing aids, outputting, by the hearing aid programmer, an audio or visual warning.

Example 4

The method of any combination of examples 1-3, further comprising: initializing, while the first hearing aid is fitted to a particular patient, a feedback cancelation loop of the first hearing aid to generate an estimated initial feedback cancelation configuration; and responsive to determining that a difference between a parameter of the estimated initial feedback cancelation configuration and a corresponding parameter of the predicted initial feedback cancelation configuration is greater than a threshold difference, outputting, by the hearing aid programmer, an audio or visual warning.

Example 5

The method of any combination of examples 1-4, wherein the predicted initial feedback cancelation configuration comprises one or more predicted coefficients of a filter included in a feedback cancelation loop of the first hearing aid.

Example 6

The method of example 5, wherein the one or more predicted coefficients comprise one or more poles of the filter.

Example 7

The method of any combination of examples 1-6, wherein the predicted initial feedback cancelation configuration comprises one or more of: a predicted adaptation speed of a feedback cancelation loop of the first hearing aid; and an (OPM) rate of the first hearing aid.

Example 8

The method of any combination of examples 1-7, further comprising: obtaining, based on initialization settings used to during initialization of the plurality of other hearing aids having the same values for the one or more properties as the first hearing aid, predicted initialization settings for the first hearing aid; and outputting, by the hearing aid programmer, an indication of the predicted initialization settings for the first hearing aid.

Example 9

The method of any combination of examples 1-8, wherein the one or more properties of the first hearing aid include one or more of: one or more physical properties of the first hearing aid; and one or more properties of a digital signal processor (DSP) of the first hearing aid.

Example 10

The method of example 9, wherein the one or more physical properties of the first hearing aid include one or more of: a vent size; a model; and one or more physical properties of an earmold of the first hearing aid.

Example 11

A hearing aid programmer comprising: an output configured to program hearing aids; one or more processors configured to perform the method of any combination of examples 1-10.

Example 12

A hearing aid programmer comprising means for performing the method of any combination of examples 1-10.

Example 13

A computer-readable storage medium storing instructions that, when executed, cause one or more processors of a hearing aid programmer to perform the method of any combination of examples 1-10.

Example 14

A method comprising: obtaining, by one or more processors, feedback cancelation configurations of a plurality of hearing aids and values of one or more properties of the plurality of hearing aids; determining, by the one or more processors and based on feedback cancelation configurations of hearing aids of the plurality of hearing aids that have a particular set of values of the one or more properties, a predicted initial feedback cancelation configuration for a hearing aid having the particular set of values for the one or more properties; and outputting, for transmission to a hearing aid programmer, the determined predicted initial feedback cancelation configuration for the hearing aid having the particular set of values for the one or more properties.

Example 15

The method of example 14, wherein the predicted initial feedback cancelation configuration comprises a predicted initial bulk delay value of a feedback cancelation loop of the hearing aid of the particular patent.

Example 16

The method of any combination of examples 14-15, further comprising: obtaining a maximum stable gain (MSG) for the plurality of hearing aids that have the particular set of values of the one or more properties; determining, based on differences between MSGs of corresponding left-right pairs of hearing aids of the plurality of hearing aids that have the particular set of values of the one or more properties, a threshold MSG difference for hearing aids having the particular set of values for the one or more properties; and outputting, for transmission to the hearing aid programmer, the determined threshold MSG difference for hearing aids having the particular set of values for the one or more properties.

Example 17

The method of any combination of examples 14-16, wherein the predicted initial feedback cancelation configuration comprises one or more predicted coefficients of a filter included in a feedback cancelation loop of the hearing aid.

Example 18

The method of example 17, wherein the one or more predicted coefficients comprise one or more poles of the filter.

Example 19

The method of any combination of examples 14-19, wherein the predicted initial feedback cancelation configuration comprises a predicted adaptation speed of a feedback cancelation loop of the hearing aid.

Example 20

The method of any combination of examples 14-19, wherein the one or more properties of the hearing aid include one or more of: one or more physical properties of the hearing aid; and one or more properties of a digital signal processor (DSP) of the hearing aid.

Example 21

The method of example 20, wherein the one or more physical properties of the hearing aid include one or more of: a vent size; a model; and one or more physical properties of an earmold of the hearing aid.

Example 22

A system comprising: a storage device configured to store feedback cancelation configurations of a plurality of hearing aids and values of one or more properties of the plurality of hearing aids; one or more processors operatively connected to the memory, the one or more processors configured to perform the method of any combination of examples 14-21.

Example 23

A system comprising means for performing the method of any combination of examples 14-21.

Example 24

A computer-readable storage medium storing instructions that, when executed, cause one or more processors of a system to perform the method of any combination of examples 14-21.

Example 25

A method comprising: receiving, by one or more processors of a hearing aid, a predicted initial feedback cancelation configuration for the first hearing aid having one or more properties, wherein the initial feedback cancelation configuration is based on feedback cancelation configurations of other hearing aids having the same properties as the hearing aid; and controlling, by the one or more processors, the hearing aid based on the predicted initial feedback cancelation configuration.

Example 26

The method of example 25, further comprising the method of any combination of examples 1-10.

Example 27

A hearing aid comprising: one or more microphones; one or more speakers; a communication module configured to receive a predicted initial feedback cancelation configuration for the hearing aid, wherein the initial feedback cancelation configuration is based on feedback cancelation configurations of other hearing aids having the same properties as the hearing aid; and a signal processor configured to implement a feedback cancelation loop between the one or more microphones and the one or more speakers based on the predicted initial feedback cancelation configuration.

Example 28

The hearing aid of example 27, wherein the one or more processors are configured to perform the method of any combination of examples 1-10.

Example 29

A hearing aid comprising means for performing the method of any combination of examples 1-10.

Example 30

A computer-readable storage medium storing instructions that, when executed, cause one or more processors of a hearing aid to perform the method of any combination of examples 1-10.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

The invention claimed is:

1. A method comprising:

determining, by one or more processors of a hearing aid programmer, values for one or more properties of a first hearing aid;

obtaining, by the one or more processors, based on feedback cancelation configurations of a plurality of other hearing aids having the same values for the one or more properties as the first hearing aid, a predicted initial feedback cancelation configuration for the first hearing aid;

programming, by the one or more processors, the first hearing aid based on the predicted initial feedback cancelation configuration;

initializing, while the first hearing aid is fitted to a particular patient, a feedback cancelation loop of the first hearing aid to generate an estimated initial feedback cancelation configuration; and responsive to determining that a difference between a parameter of the estimated initial feedback cancelation configuration and a corresponding parameter of the predicted initial feedback cancelation configuration is greater than a threshold difference, outputting, by the hearing aid programmer, an audio or visual warning.

2. The method of claim 1, wherein the predicted initial feedback cancelation configuration comprises a predicted initial bulk delay value of a feedback cancelation loop of the first hearing aid.

3. The method of claim 2, wherein the predicted initial bulk delay value is a predicted initial bulk delay value for the first hearing aid, the method further comprising:

initializing, while the first hearing aid is fitted to an ear of a particular patient, the feedback cancelation loop of the first hearing aid to estimate a maximum stable gain (MSG) for the first hearing aid;

initializing, while a second hearing aid is fitted to another ear of the particular patient, a feedback cancelation loop of the second hearing aid to estimate an MSG for the second hearing aid; and responsive to determining that a difference between the MSG for the first hearing aid and the MSG for the second hearing aid is greater than a threshold MSG difference that is determined based on differences between MSGs of corresponding left-right pairs of the plurality of other hearing aids, outputting, by the hearing aid programmer, an audio or visual warning.

4. The method of claim 1, wherein the predicted initial feedback cancelation configuration comprises one or more predicted coefficients of a filter included in a feedback cancelation loop of the first hearing aid.

5. The method of claim 4, wherein the one or more predicted coefficients comprise one or more poles of the filter.

6. The method of claim 1, wherein the predicted initial feedback cancelation configuration comprises one or more of:

a predicted adaptation speed of a feedback cancelation loop of the first hearing aid; and an (OPM) rate of the first hearing aid.

7. The method of claim 1, further comprising:

obtaining, based on initialization settings used during initialization of the plurality of other hearing aids having the same values for the one or more properties as the first hearing aid, predicted initialization settings for the first hearing aid; and outputting, by the hearing aid programmer, an indication of the predicted initialization settings for the first hearing aid.

8. The method of claim 1, wherein the one or more properties of the first hearing aid include one or more of:

one or more physical properties of the first hearing aid; and one or more properties of a digital signal processor (DSP) of the first hearing aid.

9. The method of claim 8, wherein the one or more physical properties of the first hearing aid include one or more of:

a vent size;

a model; and one or more physical properties of an earmold of the first hearing aid.

10. A hearing aid programmer comprising:

an output configured to program hearing aids; and one or more processors configured to:

determine values for one or more properties of a first hearing aid;

obtain, based on feedback cancelation configurations of a plurality of other hearing aids having the same values for the one or more properties as the first hearing aid, a predicted initial feedback cancelation configuration for the first hearing aid; and program, via the output, the first hearing aid based on the predicted initial feedback cancelation configuration;

initialize, while the first hearing aid is fitted to a particular patient, a feedback cancelation loop of the first hearing aid to generate an estimated initial feedback cancelation configuration; and responsive to determining that a difference between a parameter of the estimated initial feedback cancelation configuration and a corresponding parameter of the predicted initial feedback cancelation configuration is greater than a threshold difference, output an audio or visual warning.

11. A method comprising:

obtaining, by one or more processors, feedback cancelation configurations of a plurality of hearing aids and values of one or more properties of the plurality of hearing aids;

determining, by the one or more processors and based on feedback cancelation configurations of hearing aids of the plurality of hearing aids that have a particular set of values of the one or more properties, a predicted initial feedback cancelation configuration for a hearing aid having the particular set of values for the one or more properties, wherein the predicted initial feedback cancelation configuration comprises a predicted adaptation speed of a feedback cancelation loop of the hearing aid; and outputting, for transmission to a hearing aid programmer, the determined predicted initial feedback cancelation configuration for the hearing aid having the particular set of values for the one or more properties.

12. The method of claim 11, wherein the predicted initial feedback cancelation configuration comprises a predicted initial bulk delay value of a feedback cancelation loop of the hearing aid of the particular patent.

13. The method of claim 11, further comprising:

obtaining a maximum stable gain (MSG) for the plurality of hearing aids that have the particular set of values of the one or more properties;

determining, based on differences between MSGs of corresponding left-right pairs of hearing aids of the plurality of hearing aids that have the particular set of values of the one or more properties, a threshold MSG difference for hearing aids having the particular set of values for the one or more properties; and outputting, for transmission to the hearing aid programmer, the determined threshold MSG difference for hearing aids having the particular set of values for the one or more properties.

14. The method of claim 11, wherein the predicted initial feedback cancelation configuration comprises one or more predicted coefficients of a filter included in a feedback cancelation loop of the hearing aid.

15. The method of claim 14, wherein the one or more predicted coefficients comprise one or more poles of the filter.

16. The method of claim 11, wherein the one or more properties of the hearing aid include one or more of:

one or more physical properties of the hearing aid; and one or more properties of a digital signal processor (DSP) of the hearing aid.

17. The method of claim 16, wherein the one or more physical properties of the hearing aid include one or more of:

a vent size;

a model; and one or more physical properties of an earmold of the hearing aid.

18. A system comprising:

a storage device configured to store feedback cancelation configurations of a plurality of hearing aids and values of one or more properties of the plurality of hearing aids;

one or more processors operatively connected to the memory, the one or more processors configured to determine, based on feedback cancelation configurations of hearing aids of the plurality of hearing aids that have a particular set of values of the one or more properties, a predicted initial feedback cancelation configuration for a hearing aid having the particular set of values for the one or more properties, wherein the predicted initial feedback cancelation configuration comprises a predicted adaptation speed of a feedback cancelation loop of the hearing aid; and an output configured to transmit, to a hearing aid programmer, the determined predicted initial feedback cancelation configuration for the hearing aid having the particular set of values for the one or more properties.

* * * * *